US005350244A

United States Patent [19]

Büttner

[11] Patent Number: 5,350,244

[45] Date of Patent: Sep. 27, 1994

[54] KEYBOARD FOR TYPEWRITER AND THE LIKE

[75] Inventor: Gunter Büttner, Nürnberg, Fed. Rep. of Germany

[73] Assignee: TA Triumph-Adler AG, Nürnberg, Fed. Rep. of Germany

[21] Appl. No.: 726,039

[22] Filed: Jul. 5, 1991

[30] Foreign Application Priority Data

Jul. 19, 1990 [DE] Fed. Rep. of Germany ..... 4022917

[51] Int. Cl.[5] ..... B41J 5/14

[52] U.S. Cl. ..... 400/496; 400/490; 400/495; 400/689

[58] Field of Search ..... 400/496, 488, 490, 495, 400/495.1, 689, 446, 445.3, 449

[56] References Cited

U.S. PATENT DOCUMENTS

| | | | |
|---|---|---|---|
| 3,623,565 | 11/1971 | Ward et al. | 464/47 |
| 3,720,801 | 3/1973 | Yanaga | 400/496 |
| 4,010,838 | 3/1977 | Sims, Jr. | 400/496 |
| 4,384,796 | 5/1983 | Denley | 400/495.1 |
| 4,802,779 | 2/1989 | Allaire | 400/496 |
| 5,044,784 | 9/1991 | Lisowsky | 384/536 |
| 5,044,785 | 9/1991 | Bair et al. | 384/536 |

*Primary Examiner*—Edgar S. Burr
*Assistant Examiner*—Lynn D. Hendrickson
*Attorney, Agent, or Firm*—Michael J. Striker

[57] ABSTRACT

A keyboard for a typwriter and the like, has at least one elongated key, elements for swivellably supporting the key and including at least one substantially U-shaped bracket with a U-bottom, two U-legs connected with opposite ends of the U-bottom, and two projections extending from free ends of the U-legs and parallel to the U-bottom, such that the key is swivellably supported on the projections with a play. At least two stationary swivel bearings swivellably support the U-bottom of the bracket. At least one of the bracket and the key is supported in a bearing point in a noise-dampening manner.

7 Claims, 3 Drawing Sheets

KEYBOARD FOR TYPEWRITER AND THE LIKE

BACKGROUND OF THE INVENTION

The present invention relates to a keyboard for a typewriter and the like.

More particularly it relates to such a keyboard which has at least one elongated key supported by a substantially U-shaped bracket with a U-bottom swivellably supported in two stationary swivel bearings and with two projections extending parallel to the U-bottom from free ends of U-legs of the bracket and swivellably supporting the key with a play. The key is guided substantially perpendicularly to a base plate of the housing.

Keyboards of the above mentioned general type are known in the art.

In view of the specifics of these machines such a key, which for example in conventional writing machines is arranged as a space key on the lower edge of the keyboard, is supported with a play. Therefore during the actuation of the key, relatively strong, disturbing noise generation is produced. The noise during the end strike of the key is especially intensely radiated through the key head having a relatively large surface.

SUMMARY OF THE INVENTION

Accordingly, lit is an object of the present invention to provide a keyboard of the above-mentioned general type which avoids the disadvantages of the prior art.

More particularly it is an object of the present invention to provide a keyboard which is designed so that the noise generation during actuation of such a key and during its end strike is substantially reduced.

In keeping with these objects and with others which will become apparent hereinafter, one feature of the present invention resides, briefly stated, in a keyboard in which the bracket and/or the key are supported on a bearing point in a noise-dampening manner.

Due to the provision of the noise-dampening features on the bearing points which has not been an issue under consideration before, a subtantial noise dampening is obtained.

In accordance with another advantageous feature of the present invention, a third, inner swivel bearing is provided in the region of the U-bottom of the bracket between two other outer swivel bearings. The third swivel bearing defines a swivel axis which is offset relative to the swivel axis of the outer swivel bearings.

Therefore the bracket which, as a rule, is composed of a round metal is subjected to a slight elastic pretensioning during its insertion into the swivel bearing. As a result, it is easily accessible in the swivel bearing and at the same time is movable without the conventional play and so that the noise connected with the play is eliminated.

In accordance with a further advantageous feature of the present invention, the third, inner swivel bearing is formed as a partially circular, open bearing recess. Therefore it is possible to easily engage the bracket into the bearing during the mounting.

In accordance with still a further embodiment of the present invention, the bearing member of a noise-dampening material is arranged on the key, so that the projections of the U-legs of the brackets engage in the bearing member. The bearing member can be composed of rubber, soft synthetic plastic material, etc.

Thereby a noise generation during movement of the key is prevented, which is attributed to the fact that the bearing projections of the bracket must engage with the key for compensation of the play connected with movement components produced during the swivel movement parallel to the base plate of the housing. In addition to a noise suppression in the place of its generation, also a noise transmission to the key head and thereby a radiation of the noise from the key head is prevented.

Still another advantageous feature of the present invention resides in that the bearing member is fitted on a holding rib of the key. Thereby, a simple and safe, cost-favorable mounting is performed.

Still another feature of the present invention is that the bearing member surround the projections of the bracket in a U-shaped manner. Therefore the bearing members simultaneously serve as an end abutment during pressing of the key against the base plate of the housing. This abutment dampens and further suppresses the noise generation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
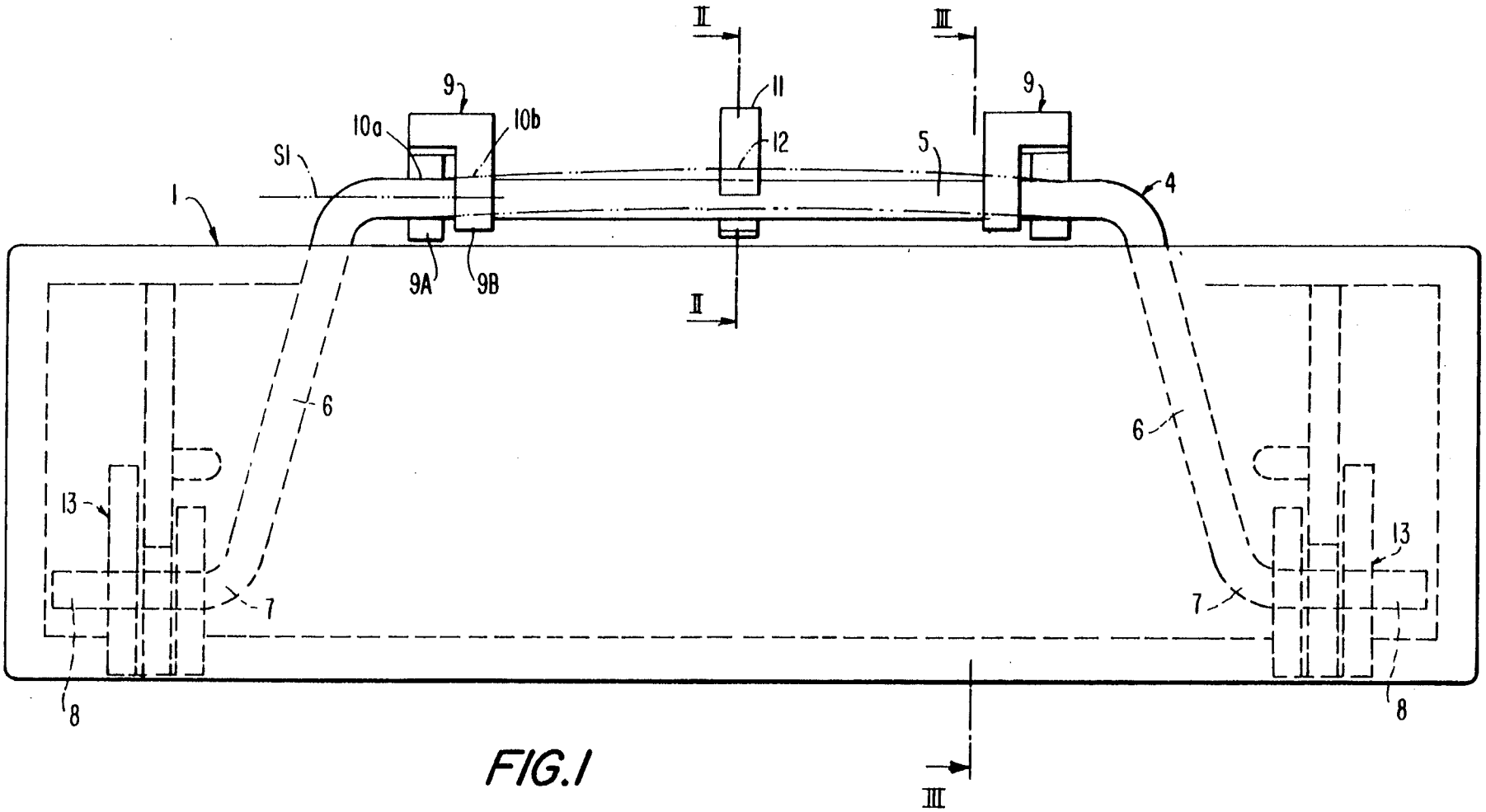
FIG. 1 is a view showing a space key of a keyboard for a typewriter, in accordance with the present invention.
Figure 3:
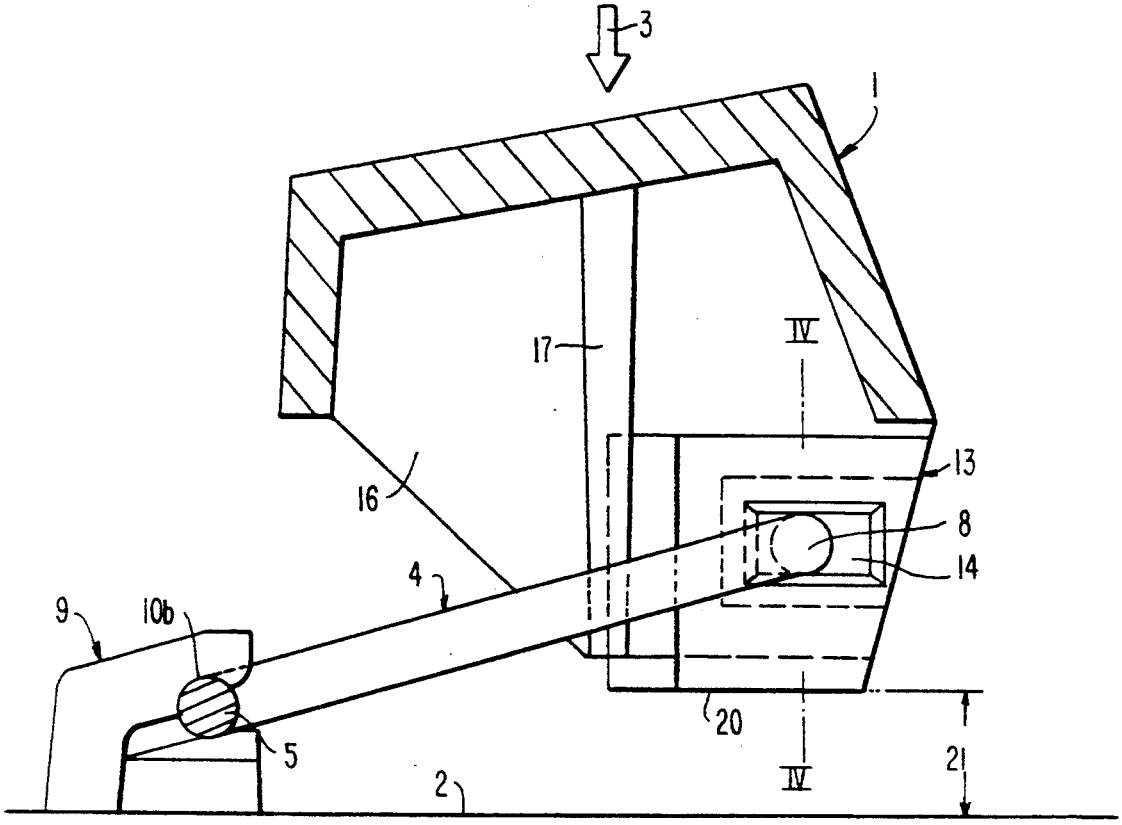
FIG. 3 is a view showing a section taken along the line III—III in FIG. 1.
Figure 4:
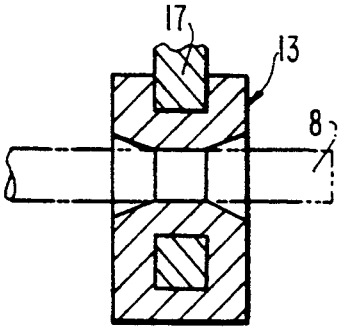
FIG. 4 is a view showing a bearing part in a section taken along the line IV—IV in FIG. 3.
Figure 5:
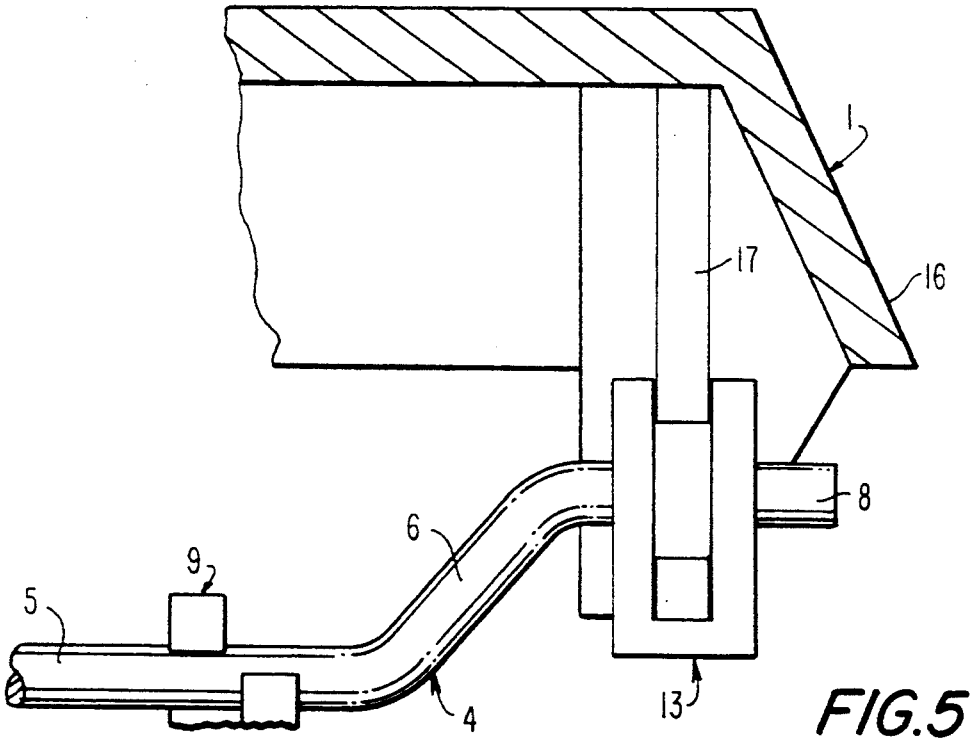
FIG. 5 is a view showing a section of an end bearing region of the key.
Figure 6:
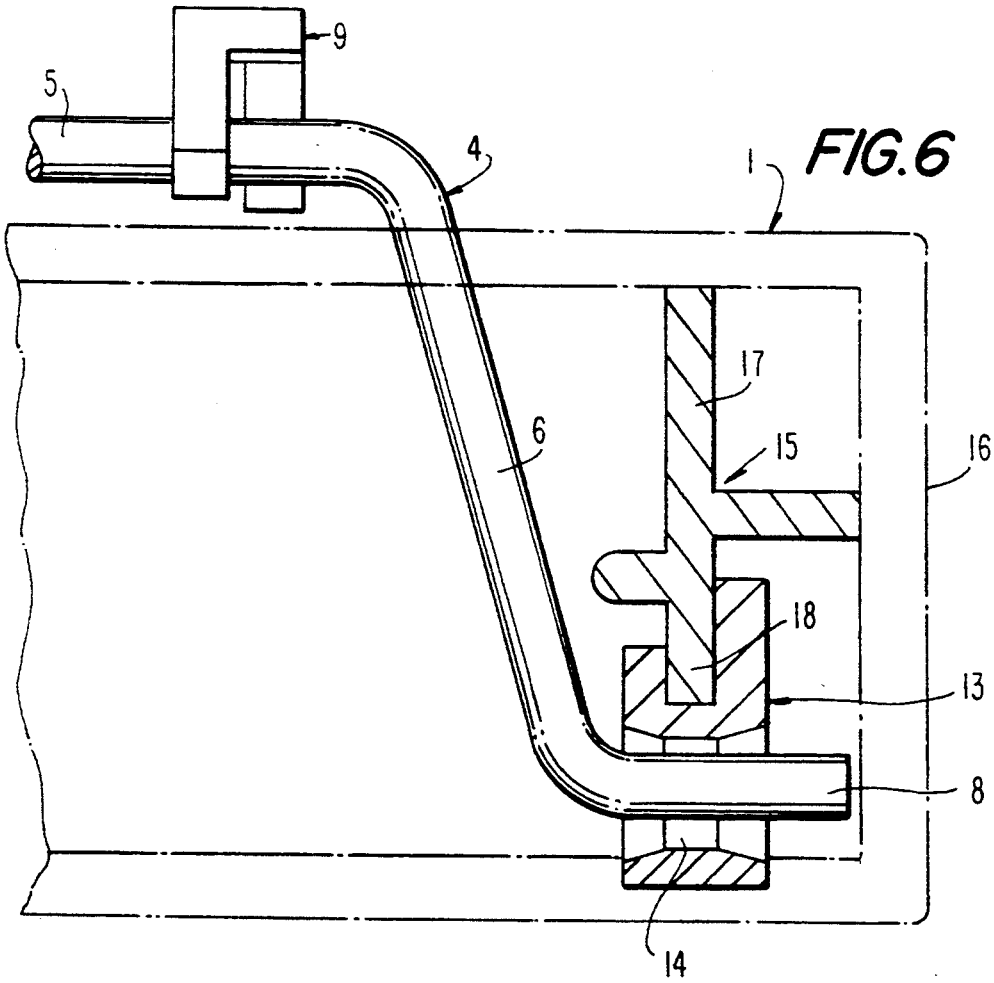
FIG. 6 is a view showing a section corresponding to that of FIG. 5 from a position turned by 90°.

In a keyboard in accordance with the present invention, only one space key is shown in FIG. 1 and identified with reference numeral 1, as conventional in keyboards of typewriters. The key 1 is supported on a base plate 2 of the typewriter which is schematically shown in FIG. 3. It is supported movably in direction of the arrow 3 in FIG. 3.

For this purpose the keyboard has a substantially U-shaped bracket 4. The U-shaped bracket 4 has correspondingly a U-bottom 5, two U-legs 6 connected with two ends of the U-bottom,and two bearing projections connected with free ends 7 of the legs 6 and extending parallel to the U-bottom 5.

The bracket 4 is supported turnably in two outer swivel bearings 9 which are connected with the base plate 2. Each swivel bearing 9 has two swivel bearing portions **9*a* and 9*b* which are offset relative to one another and provided with lower and upper semi-circular recesses 10*a* and 10*b*. Correspondingly, the U-bottom 5 of the bracket 4 is engageable in the swivel bearing 9 with its elastic expansion and in particular with the elastic expansion of the upper swivel bearing parts 9*b***.

The recesses 10*a* and 10*b* of both swivel bearings 9 define a swivel axis S1, as shown in FIG. 1.

Figure 2:
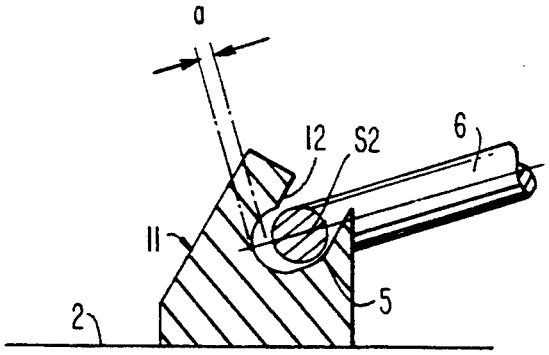
FIG. 2 is a view showing a section taken along the line II—II in FIG. 1, illustrating a pre-tensioning of a mounting bracket for the inventive key.

A third inner swivel bearing 11 is located between both outer swivel bearings 9 and mounted on the base plate 2. The inner bearing 11 has a rearwardly and upwardly open recess 12 as considered in FIG. 1. The recess 12 has a semicircular cross-section. Its center is offset relative to the center of the recesses of the swivel bearings 10*a* and 10*b*. This center defines a swivel axis S2 located at a distance a from the swivel axes S1 defined by both outer swivel bearings 9, as shown in FIG. 2. Thereby the U-bottom 5 of the bracket 4 is somewhat elastically pre-stressed. As a result, the bracket 4 is slightly movable in swivel bearings 9 and 11 on the one hand, and at the same time is guided in a play-free and therefore noise-free manner on the other hand.

The bearing projections 8 of the bracket 4 are connected with the key 1 through bearing parts 13 composed of rubber or soft synthetic material. The projections 8 engage in a recess 14 of the bearing parts 13 in a direction perpendicular to the base plate 2 in a form-locking manner and in a direction parallel to it with a play. Therefore the movement components parallel to the base plate 2 during a swivel movement of the bracket 4 about the swivel axis S1 can be compensated, and the key 1 on the other hand, as not shown in the drawing, is guided in a play-free manner in a direction perpendicular to the base plate 2 and identified with the arrow 3. Correspondingly the swivel movement of the bracket 4 in a pure linear movement perpendicularly to the base plate 2 is shifted.

A rib structure 15 is provided inside the key 1. The rib structure includes a rib 17 which extends parallel to an outer wall 16 of the key 1. A bearing part 13 is fitted on the rib 17 through a groove-shaped recess 18.

From the above description it can be seen that the recess 14 of the bearing 13 is surrounded by a noise-dampening material. Therefore a noise generation during the actuation of the key and therefore the related swivel movement of the bracket 4 is suppressed from the very beginning, and a sound propagation to the upper side of the key 1 especially to the key surface 19 and thereby a sound radiation from it is eliminated.

Each bearing part 13 surrounds the bearing projection 8 with the bracket 4 in a U-shaped or O-shaped fashion, so that a lower side 20 of each bearing part 13 acts as an abutment relative to the base plate 2 during the actuation of the key 1, in correspondence with the actuation play space identified with the arrow 21. Thereby the striking of the key 1 against the abutment is dampened and similarly a propagation of the thusly caused body sound in the actuation surface 19 is avoided.

It will be understood that each of the elements described above, or two or more together, may also find a useful application in other types of constructions differing from the types described above.

While the invention has been illustrated and described as embodied in a keyboard, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A keyboard, comprising at least one elongated key; means for swivellably supporting said key and including at least-one bracket which is substantially U-shaped and has a bottom, two legs connected with opposite ends of said bottom and having free ends forming two projections parallel to said bottom, such that said at least one elongated key is swivellably supported on said projections; at least two stationary swivel bearings swivellably supporting said bottom of said at least one bracket; means for supporting one of said at least one bracket and said at least one elongated key so as to dampen noise produced during actuation of said at least one elongated key, said means including a bearing member which is composed of a noise-dampening material selected from the group consisting of rubber and synthetic plastic material and mounted on said at least one elongated key so that said projections of said legs of said at least one bracket engage in said bearing member so as to dampen noise generation during actuation of said at least one elongated key.

2. A keyboard as defined in claim 1; and further comprising a base plate, said at least one bracket guides said at least one elongated key substantially perpendicularly to said base plate.

3. A keyboard as defined in claim 1, and further comprising a third swivel bearing located between said first mentioned two swivel bearings and swivellably supporting said bottom of said at least one bracket.

4. A keyboard as defined in claim 3, wherein said first two swivel bearings together define a first swivel axis, said third swivel bearing defining a further swivel axis which is offset relative to said first swivel axis defined by said first two swivel bearings.

5. A keyboard as defined in claim 3, wherein said third swivel bearing has a semi-circular open bearing recess for supporting said bottom of said at least one bracket.

6. A keyboard as defined in claim 1, wherein said at least one elongated key is provided with a holding rib, said bearing member being fitted on said holding rib.

7. A keyboard as defined in claim 1, wherein said bearing member surrounds said projections of said at least one bracket in a substantially U-shaped manner and has an outer side which acts as an abutment surface for said at least one bracket.

* * * * *